US007249616B2

(12) United States Patent
Turri et al.

(10) Patent No.: US 7,249,616 B2
(45) Date of Patent: Jul. 31, 2007

(54) DEVICE FOR FILLING TONER CONTAINER

(75) Inventors: Giuseppe Turri, Anagni-Fr (IT); Giuseppe Cerasaro, Anagni-Fr (IT); Alessandro Turri, Anagni-Fr (IT); Didier Desschans, Kortrijk (BE); Dirk Vanderschueren, Oudenaarde (BE)

(73) Assignee: CF Technologies, Deinze (BE)

( * ) Notice: Subject to any disclaimer, the term of this patent is extended or adjusted under 35 U.S.C. 154(b) by 194 days.

(21) Appl. No.: 10/940,301

(22) Filed: Sep. 13, 2004

(65) Prior Publication Data

US 2006/0021672 A1 Feb. 2, 2006

(30) Foreign Application Priority Data

Jul. 27, 2004 (IT) ..... FR2004A0012

(51) Int. Cl.
*B65B 1/04* (2006.01)

(52) U.S. Cl. ..... 141/67; 141/71; 141/2; 141/18; 222/66

(58) Field of Classification Search ..... 141/2, 141/18, 67, 71, 11, 12, 69; 222/66, 207, 222/214, 241

See application file for complete search history.

(56) References Cited

U.S. PATENT DOCUMENTS

| | | | | |
|---|---|---|---|---|
| 4,561,759 | A | 12/1985 | Knott | |
| 5,139,176 | A | 8/1992 | Eben et al. | |
| 5,168,905 | A | 12/1992 | Phallen | |
| 5,921,295 | A | 7/1999 | Zelazny et al. | |
| 5,947,169 | A | 9/1999 | Wegman et al. | |
| 5,953,567 | A * | 9/1999 | Muramatsu et al. | 399/256 |
| 6,142,340 | A * | 11/2000 | Watanabe et al. | 222/66 |
| 6,253,968 | B1 * | 7/2001 | Van Dijk et al. | 222/241 |
| 6,722,406 | B2 | 4/2004 | Wegman et al. | |
| 2004/0011425 | A1 | 1/2004 | Wegman et al. | |
| 2004/0060611 | A1 | 4/2004 | Amano et al. | |
| 2004/0134560 | A1 | 7/2004 | Sato et al. | |

FOREIGN PATENT DOCUMENTS

| | | | |
|---|---|---|---|
| CA | 2269363 | A1 | 10/2000 |
| EP | 0 239 255 | A1 | 9/1987 |
| EP | 0 473 348 | A1 | 3/1992 |
| EP | 0 900 732 | A2 | 3/1999 |
| EP | 0 928 743 | A1 | 7/1999 |
| EP | 1 380 501 | A2 | 1/2004 |
| FR | 2 567 498 | A1 | 1/1986 |

OTHER PUBLICATIONS

Abstract. Japanese Patent Appln. No. JP 2001-180602, "Toner Filling Apparatus", Ricoh Unitechno KK, Jul. 3, 2001.

Abstract. French Patent Appln. No. FR 2,567,498, "Method and devices permitting transfer of dry powders towards a liquit medium, overcoming the problems posed by dust and the formation of crust", Jean Costes, Jan. 17, 1986.

(Continued)

*Primary Examiner*—Steven O. Douglas
(74) *Attorney, Agent, or Firm*—Darby & Darby

(57) ABSTRACT

Device for filling dry toner powder from a bag into a toner container, said device comprising a piping system with a flexible and compressible pipe and a peristaltic pump acting on said flexible and compressible pipe.

101 Claims, 11 Drawing Sheets

OTHER PUBLICATIONS

Abstract. Japanese Patent Appln. No. JP 2004-083130, "Toner filling device and toner product information measurement processing system", Ricoh Co., Ltd., Mar. 18, 2004.

Abstract. Japanese Patent Appln. No. JP-2000-194184, "Toner Filling Up Method and Device", Ricoh Co., Ltd., Jul. 14, 2000.

Abstract. Japanese Patent Appln. No. JP 61-27501, "Toner Filling Method", Mitsubishi Kasei Corp., May 10, 1994.

European Search Report issued for EP Appl No. 05 44 7171, Completion date of Search Report Nov. 7, 2005.

* cited by examiner

DEVICE FOR FILLING TONER CONTAINER

This application claims priority of Italian Patent Application No. FR2004A000012, filed Jul. 27, 2004, which is incorporated herein by reference.

1. Field of the Invention

The invention relates to a device for filling toner container, such as toner cartridges, toner bottles, plastic bags, etc.

2. The Prior Art

Toner is a powder used in fax machine, laser printer, copiers, etc. Toner particles have a size of less than 10 μm, preferably less than 3 μm. These machines use toner cartridges, filling toner bottles, etc. which have to be replaced or refilled regularly.

For the manufacture of said toner cartridges or filling toner bottles or for the recycling of said toner cartridges or filling toner bottles, a filling device is used for introducing fresh toner in the container.

Various devices have been proposed for filling toner containers and toner bottles.

JP6127501 discloses a toner filling device comprising a feeder controlling the supply of toner particles in a funneled part, the lower end of which is connected to the opening of the toner container to be filled. The feeder comprises an endless screw controlling the supply of toner in the funneled part, while a rod agitator is turned in the funneled part so as to increase the flow of toner particles in the toner container to be filled. Two different funnels are necessary, whereby the possible escape of toner particles during a filling operation is possible at the bottle neck, at the top of the funnel placed above the container or bottle, at the top of the feeding funnel and at the endless screw.

When having to fill various containers with various different color toner or various toner quality, it is necessary to clean carefully the two funnels and the endless screw. Such a cleaning takes times. Furthermore, the risk of contamination from different toners still exists.

EP 0 928 743 discloses a pneumatic valve for filling a toner container with toner particles issuing from a hopper through a conduit. When having to fill different container with different toner, a cleaning operation of the complete filling system is required. This is time consuming. Furthermore, the risk of contamination from different toners still exists.

U.S. Pat. No. 5,947,169 discloses an oscillating valve for powders for improving the flow of powders in a toner container.

CA2269363 relates to a high speed nozzle for toner filling system comprising a hopper and a conduit with an inner conveyor. When having to fill different container with different toner, a cleaning operation of the complete filling system is required. This is time consuming. Furthermore, the risk of contamination from different toners still exists.

JP2000194184 discloses a toner filling device comprising a hopper, the bottom of which is provided with a conduit in which an endless screw extends. Said screw is rotated by a motor. When having to fill different container with different toner, a cleaning operation of the complete filling system is required. This is time consuming. Furthermore, the risk of contamination from different toners still exists.

U.S. Pat. No. 6,722,406 discloses an apparatus for cleanly cutting off filling of a container said apparatus is placed at the end of a conduit connected to a hopper, an endless screw is located with the conduit. When having to fill different container with different toner, a cleaning operation of the complete filling system is required. This is time consuming. Furthermore, the risk of contamination from different toners still exists.

JP2004083130 discloses a toner filling device provided with a detecting part for detecting the weight of the container and controlling the timing for discharging the toner from the hopper into the container. When having to fill different container with different toner, a cleaning operation of the complete filling system is required. This is time consuming. Furthermore, the risk of contamination from different toners still exists.

FR2567498 discloses a moistening device comprising a peristaltic pump. The device is not used for moving dry toner powder.

The invention relates to a simple device, not expensive, enabling a quick change of the filling operation from one toner to another toner, without having to clean any part of the device and without risk of contamination. The invention relates also to a process for filling a toner container, which enables a quick change in the filling operation, such as passing quickly, without special cleaning operation, from the filling of containers with a first type of toner to the filling of containers with a second type of toner. In the device of the invention, advantageously all parts in contact with one toner are changed when having to fill containers with another toner. No contamination can thus occur.

BRIEF DESCRIPTION OF THE INVENTION

The invention elates to a device for filling dry toner powder from a supplying means in a toner container, said device comprising:

- a piping system comprising a flexible and compressible pipe portion, with an inlet adapted to be connected to the supplying means for enabling a flow of toner powder from the supplying means and with an outlet,
- at least one means for maintaining at least one portion of the piping system so that the outlet is at a level situated below the inlet,
- at least one compressing means for compressing at least partly the flexible and compressible pipe portion, and
- at least one means for ensuring a relative movement between the compressing means and the flexible and compressible pipe portion to be compressed so as to create a pushing of the toner present in said flexible and compressible pipe portion towards the outlet.

Advantageously, the device comprises means for maintaining the piping system from the inlet to the outlet in a continuous downwards path.

Advantageously, the flow of toner particles is pulsated continuously downwardly.

According to an embodiment, the means for compressing a portion of the pipe comprises at least one roller, advantageously at least two rollers, preferably at least three rollers or more (for example 4, 5, 6, 8 or 10).

According to an advantageous embodiment, in which the portion of the pipe to be compressed extends between a first transversal section and a second transversal section, the device comprises means for maintaining curved the portion between said first and second transversal sections, so that said curved portion has a minimum radius of curvature of at least 1 cm, preferably comprised between 1.5 cm and 10 cm, most preferably between 2 and 8 cm.

Advantageously, the ratio radius of curvature/outer diameter of the flexible and compressible portion is comprised between 3 and 10, preferably between 4 and 8.

Preferably, the portion of the pipe to be compressed is curved so as to form a portion of a circular path, said portion extending on an angle of less than 200°, such as less than 181°, most preferably less than 180°, especially comprised between 45 and 175°, more specifically between 100 and 160°.

The piping system consists advantageously substantially only of a flexible and compressible pipe.

According to an advantageous detail of the device, the pipe comprises:

- a first curved portion intended to be compressed,
- a second curved portion located between the first curved portion and the inlet, and
- a third curved portion located between the first curved portion and the outlet, whereby preferably, the second and third curved portions are adjacent to the first curved portion.

Preferably, the first curved portion, the second curved portion and the third curved portion are located substantially in a same vertical plane.

In a specific embodiment, the pipe comprises:

- a first curved portion intended to be compressed, said first portion having a bending in a first direction
- a second curved portion located between the first curved portion and the inlet, and
- a third curved portion located between the first curved portion and the outlet, whereby the second and third curved portions are adjacent to the first curved portion and have a bending in a direction opposite to the first direction.

According to another specific embodiment, the pipe comprises:

- a first curved portion intended to be compressed, said first portion having a bending in a first direction,
- a second portion adjacent to the inlet,
- a third curved portion located between the first curved portion and the second portion,
- a fourth portion adjacent to the outlet, and
- a fifth curved portion located between the first curved portion and the fourth portion, whereby the third and fifth curved portions are adjacent to the first curved portion and have a bending in a direction opposite to the first direction.

Preferably, in said embodiment, the second portion and the fourth portion are substantially vertical, while most preferably the second portion and the fourth portion extend substantially along a same vertical axis.

According to an advantageous embodiment, the device comprises a means for exerting vibration to the pipe.

Preferably, the means for ensuring a relative movement between the compressing means and the portion to be compressed so as to create a pushing of the toner present in said portion towards the outlet is also a means for exerting vibration to the pipe.

According to a specific embodiment, the device comprises a peristaltic pump acting as a compressing means of a portion of the pipe and as a means for ensuring a relative movement between the compressing means and the portion to be compressed so as to create a pushing of the toner present in said portion towards the outlet.

Advantageously, the device further comprises maintaining means for maintaining two portions of the pipe distant from the portion on which acts the peristaltic pump, whereby said maintaining means are adapted so as to enable a movement of the pipe during the working of the peristaltic pump.

According to a detail of an advantageous embodiment, the device comprises a connecting piece attached to the pipe, said connecting piece being adapted for connecting the inlet of the pipe to a supplying means.

The connecting piece is preferably adapted for ensuring a substantially complete sealing.

The device comprises advantageously a connecting piece attached to the pipe, said connecting piece being adapted for connecting the inlet of the pipe to a supplying means made of a flexible and compressible material, preferably a flexible and compressible bag.

The device comprises advantageously a supporting means adapted for supporting a toner supplying means (such as a bag, a tank with a inner volume of 5 liters to 100 liters or more, etc.) at a level above the compressing means.

For example, the supporting means is adapted for supporting a toner supplying means in a form of a flexible and compressible bag at a level above the compressing means. Preferably, said supporting means is also adapted for enabling a relative movement of the bag with respect to the supporting means. Such a relative movement is advantageous for creating some vibrations in the bag.

According to a further detail, the pipe or at least the portion of the pipe submitted to a compression has advantageously an inner diameter or equivalent diameter of less than 2 cm, preferably less than 1.5 cm. The inner diameter or inner equivalent diameter is preferably greater than 0.4 cm, most preferably greater than 0.6 cm. Preferred inner diameters are comprised between 0.7 cm and 1.4 cm.

The wall thickness of the pipe or at least the portion submitted to compression steps is comprised between 0.1 and 1 cm, the ratio wall thickness/inner diameter being advantageously comprised between 1:5 and 1:2, preferably between 1:4.5 and 1:3.5.

Such a ratio is preferable for ensuring the best flow of toner particles in the compressible pipe portion.

According to a further detail, the device controls the flow of toner particles or is provided with a control means so that the maximum flow is advantageously lower than 3 kg per minute, preferably lower than 2 kg per minute, most preferably comprised between 0.1 kg and 1.6 kg per minute, such as 0.5 kg/minute, 0.8 kilo/minute; 1 kg/minute, 1.4 kg/minute.

According to a specific embodiment, the device comprises a peristaltic pump acting as a compressing means of a portion of the pipe and as a means for ensuring a relative movement between the compressing means and the portion to be compressed so as to create a pushing of the toner present in said portion towards the outlet, whereby said peristaltic pump comprises at least three rollers adapted for compressing a curved portion of the pipe, whereby said portion is located with respect to the peristaltic pump so that a roller starts to exert a pressure on said portion, while another roller exerts a pressure on the pipe so as to compress it only partly, preferably so that a roller starts to exert a pressure on said portion, while another roller exerts substantially no pressure on the pipe.

According to a detail of a further embodiment, the device comprises a structure with a supporting means adapted for supporting a toner supplying means, whereby said supporting means is mounted mobile with respect to the toner supplying means. For example, the supporting means can be pivoted downwardly, so that the filling of the supply means is easier or so that the removal/attachment of supply means or bags is easier.

According to another detail of an embodiment, the device comprises at least a wire mounted at least partly mobile in the pipe or piping system so as to break toner agglomerates. For example, a portion of the wire extends outside of the pipe (through a hole) so as to enable an easy actuation thereof. Such a wire can be used for breaking possible toner agglomerates formed before or after the peristaltic pump.

According to still a further embodiment, the device comprises at least one air inlet for supplying air between the inlet of the piping system and the flexible portion to be compressed.

According to still a further embodiment, the device comprises a series of peristaltic pumps so as to enable the filling of several toner containers at the same time, or so as to enable the use of one specific pump so as to fill one specific toner in the toner container, and thereafter another toner in another container.

According to still a further embodiment, the device comprises:

- several flexible and compressible pipes with an inlet adapted to be connected to the supplying means for enabling a flow of toner powder from the supplying means and with an outlet,
- maintaining means for maintaining at least one portion of each pipe so that the outlet of a pipe is at a level situated below the inlet of said pipe,
- compressing means for compressing a portion of each pipe, and
- moving means for ensuring for each pipe a relative movement between the compressing means and the portion to be compressed so as to create a pushing of the toner present in said portion towards the outlet.

Preferably, several peristaltic pumps act as compressing and moving means.

According to still a further embodiment, the device comprises a piping system comprising at least two flexible and compressible pipe portions mounted in parallel, and compressible means for acting on said two pipe portions.

The invention relates also to a process using a device of the invention for the filling of toner containers, such as toner cartridges, toner bottles, recharging systems, etc.

The process of the invention is a process for filling a toner container with toner particles issuing from a toner supplying means by means of a filling device, said device comprising:

- a piping system comprising a flexible and compressible pipe portion, with an inlet adapted to be connected to the supplying means for enabling a flow of toner powder from the supplying means and with an outlet,
- at least one means for maintaining at least one portion of the piping system so that the outlet is at a level situated below the inlet,
- at least one compressing means for compressing at least partly the flexible and compressible pipe portion, and
- at least one means for ensuring a relative movement between the compressing means and the flexible and compressible pipe portion to be compressed so as to create a pushing of the toner present in said flexible and compressible pipe portion towards the outlet, in which at least one compressing means is moved for compressing at least partly the compressible pipe portion and in which, while the compressing means is compressing at least a portion of the compressible pipe portion; a relative movement between the compressing means and the compressible pipe portion is ensured so as to push toner particles towards the outlet.

Advantageously, the piping system from the inlet to the outlet follows a continuous downwards path. During a filling operation, the toner follows thus a continuous downwards path.

In the process, a portion of the compressible pipe portion is advantageously compressed by at least one roller, preferably by at least two rollers, especially by at least three rollers. For example, during the filling operation, said portion is compressed according to a series of compression steps by a single roller, whereby an intermediate compression step by two rollers extends between two successive compression steps by one single roller.

The portion of the pipe is advantageously compressed between a first transversal section and a second transversal section, while maintaining curved the portion between said first and second transversal sections, so that said curved portion has a minimum radius of curvature of at least 1 cm, preferably comprised between 1.5 cm and 10 cm, most preferably between 2 and 8 cm.

Advantageously, the ratio radius of curvature/outer diameter of the flexible and compressible portion is comprised between 3 and 10, preferably between 4 and 8.

According to a detail, the portion of the pipe is compressed according to a portion of a circular path, said portion extending on an angle of less than 200°, advantageously less than 181°, preferably less than 180°, such as comprised between 45 and 175°, most specifically comprised between 100 and 160°.

The piping system comprises (preferably consists advantageously of substantially only one) at least one compressible and flexible pipe from the inlet up to the outlet.

According to a detail, the pipe is placed so as to form at least:

- a first curved portion intended to be compressed,
- a second curved portion located between the first curved portion and the inlet, and
- a third curved portion located between the first curved portion and the outlet, whereby the second and third curved portions are preferably adjacent to the first curved portion.

Especially, the first curved portion, the second curved portion and the third curved portion are located substantially in a same vertical plane.

According to a specific embodiment, the pipe is placed so as to define a path comprising:

- a first curved portion intended to be compressed, said first portion having a bending in a first direction
- a second curved portion located between the first curved portion and the inlet, and
- a third curved portion located between the first curved portion and the outlet, whereby the second and third curved portions are adjacent to the first curved portion and have a bending in a direction opposite to the first direction.

According to another specific embodiment, the pipe is placed so as to define a path comprising:

- a first curved portion intended to be compressed, said first portion having a bending in a first direction,
- a second portion adjacent to the inlet,
- a third curved portion located between the first curved portion and the second portion,
- a fourth portion adjacent to the outlet, and a fifth curved portion located between the first curved portion and the fourth portion, whereby the third and fifth curved portions are adjacent to the first curved portion and have a bending in a direction opposite to the first direction.

Preferably, the second portion and the fourth portion are substantially vertical, while most preferably the second portion and the fourth portion extend substantially along a same vertical axis.

According to an advantageous embodiment, during a filling operation the pipe is submitted at least partly to vibrations.

According to an embodiment, the means for ensuring a relative movement between the compressing means and the portion to be compressed pushes the toner present in said portion towards the outlet and exerts vibrations on the pipe.

According to a specific embodiment, a peristaltic pump acts as a compressing means of a portion of the pipe and as a means for ensuring a relative movement between the compressing means and the portion to be compressed so as to create a pushing of the toner present in said portion towards the outlet.

Most specifically, a peristaltic pump acts on a first portion of the pipe, while two portions of the pipe distant from the portion on which acts the peristaltic pump are maintained at least partly in position so as to enable a movement of the pipe during the working of the peristaltic pump, whereby said peristaltic pump acts as a compressing means of a portion of the pipe and as a means for ensuring a relative movement between the compressing means and the first portion to be compressed so as to create a pushing of the toner present in said first portion towards the outlet.

Advantageously, the pipe is connected to a toner supplying means by a connecting piece, so as to enable to remove the supplying means from the pipe, for example for replacing a void toner supplying means by a new toner supplying means.

Preferably, a substantially complete sealing between the pipe and the toner supplying means is ensured by the connecting piece.

For example, a flexible and compressible bag or a foldable bag is used as toner supplying means, said flexible and compressible bag being connected to the pipe by means of a connecting piece. In other possible embodiments, the supplying means is a tank with a volume for example comprised between 10 liters and 150 liters.

The toner supplying means is advantageously supported so as to extend at a level above the compressing means. The difference of levels between the toner supplying means and the compressing means is advantageously less than 3 m, preferably comprised between 10 cm and 2 m, most preferably between 15 cm and 75 cm, such as 25 cm, 40 cm, 50 cm, 60 cm.

The pipe or at least the compressible pipe portion has advantageously an inner diameter or equivalent diameter of less than 2 cm, preferably less than 1.5 cm. The equivalent diameter is preferably greater than 0.4 cm, most preferably greater than 0.6 cm. Preferred inner diameters are comprised between 0.7 cm and 1.4 cm.

The wall thickness of the pipe or at least the portion submitted to compression steps is comprised between 0.1 and 1 cm, the ratio wall thickness/inner diameter being advantageously comprised between 1:5 and 1:2, preferably between 1:4.5 and 1:3.5. Such a ratio is preferable for ensuring the best flow of toner particles in the compressible pipe portion.

In the process of the invention, the maximum flow of toner particles is advantageously lower than 3 kg per minute, preferably lower than 2 kg per minute, most preferably comprised between 0.1 kg and 1.6 kg per minute, such as 0.5 kg/minute, 0.8 kilo/minute; 1 kg/minute, 1.4 kg/minute.

Advantageously, during a filling operation, possible toner particles escaping out of the toner container are collected in a collecting means adjacent to the outlet of the pipe.

According to an embodiment, the filling operation of a toner container is controlled so as to detect when the toner container is filled.

According to an embodiment, a valve adjacent to the outlet of the pipe is controlled at least at the end of a filling operation or a valve at the outlet of the pipe is controlled at least at the end of a filling operation.

According to specific embodiments, a peristaltic pump acts as a compressing means of a portion of the pipe and as a means for ensuring a relative movement between the compressing means and the portion to be compressed so as to create a pushing of the toner present in said portion towards the outlet, whereby the peristaltic pump is adjacent to the outlet of the pipe.

According to a further detail of a specific embodiment, a pipe with anti adherence properties for toner particles is used.

According to still a further embodiment of the process, the device used comprises a series of peristaltic pumps so as to enable the filling of several toner containers at the same time, or so as to enable the use of one specific pump so as to fill one specific toner in the toner container, and thereafter another toner in another container.

According to still a further embodiment, the device used comprises:

several flexible and compressible pipes with an inlet adapted to be connected to the supplying means for enabling a flow of toner powder from the supplying means and with an outlet, maintaining means for maintaining at least one portion of each pipe so that the outlet of a pipe is at a level situated below the inlet of said pipe, compressing means for compressing a portion of each pipe, and moving means for ensuring for each pipe a relative movement between the compressing means and the portion to be compressed so as to create a pushing of the toner present in said portion towards the outlet.

Preferably, several peristaltic pumps act as compressing and moving means.

Details and characteristics will be disclosed in the description of the following preferred embodiments, in which reference is made to the attached drawings.

DESCRIPTION OF PREFERRED EMBODIMENTS

Figure 1:
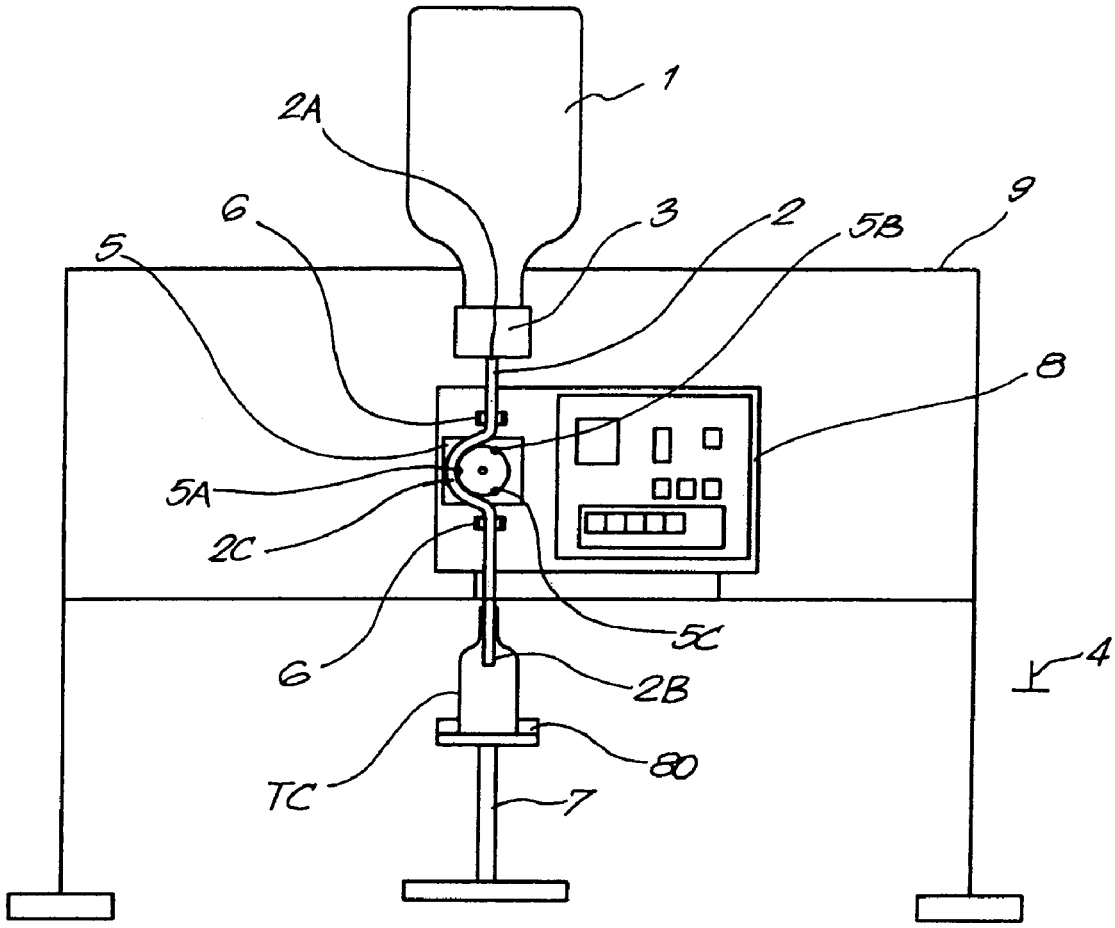
FIG. 1 is a schematic view of a device of the invention.

The device of FIG. 1 is a device for filling toner containers TC (for example a toner bottle), the one after the other, with toner T from a supply means 1. The device comprises:

- a flexible and compressible pipe 2 with an inlet 2A connected to the supply means or recipient 1 by means of a connecting piece 3, and with an outlet 2B which can be closed by a plug 4 at the end of a filling operation after removal of the outlet 2B outside of the bottle TC. The pipe 2 follows a substantially downwards path from the inlet to the outlet.
- a peristaltic pump 5 with three rollers 5A,5B,5C suitable for compressing a portion 2C of the pipe 2 and for pushing downwardly the toner present in the said compressible portion 2C of the pipe 2, said pump 5 comprising a box 6 with a movable door 7 so as to place the portion 2C of the pipe in the box, whereby said portion 2C is curved with a radius of curvature R1 of about 2 to 3 cm, said pump comprising a motor for driving into rotation the rollers so that successively and each after the other, the roller 5A,5B,5C press on the portion 2C, is moved with respect to the portion 2C while still exerting a pressure on the portion 2C of the pipe, so as to push downwardly the toner present in said portion and so as to create a suction of toner particles from the toner supply 1.
- Clips 6 for maintaining in position a portion of the pipe 2 located between the inlet 2A and the pump 5 and a portion of the pipe 2 located between the outlet 2B and the pump 5, said clips ensuring each a bending of the pipe 2 between the pump and each clip.
- A system 7 for determining the weight of the bottle or container during the filling operation.
- A control system 8 controlling the working of the pump 5 and receiving information from the system 7, so as to interrupt the working of the pump 5 when the container TC is filled with the required amount of toner.
- A structure 9 for supporting the supply container 1 and the peristaltic pump 5, as well as at least partly the control system 8.

The pump 5, when working, creates vibrations which are transmitted to the pipe, as well as to the structure. This is advantageous for the flow of particles in the pipe towards the pump, for the escape of toner at the outlet of the pipe, and for the flow of toner from the supply container 1 into the pipe 2.

In said embodiment, the pipe 2 has five portions, namely:

The curved portion 2C in the pump 5,

Two substantially vertical end portions 2D,2E adjacent respectively to the inlet 2A and the outlet 2B, and Two curved portions 2F,2G extending each between an end portion and the pump 5.

The working of said machine is quite easy. The person responsible of the filling operation fills toner in the supply container 1 (which can be a tank or drum, but preferably a flexible bag or container), said toner being for example furnished in bags, etc. After the filling of said container 1 is ended, he attaches the connector 3 to the neck of the supply container 1. If the supplying means is a bag, the upper structure can be pivoted so that the bag can be more easily fixed to the connector 3, and then pivoted back in its working position for filling operation.

The machine is now ready for filling toner cartridges or refilling bottles for toner cartridges. He places a container to be filled on the system 7, the container TC being advantageously maintained in position for example by a foam layer 80 with an opening in which the bottom of the bottle 2 can be inserted.

The outlet 2B of the pipe is introduced in the bottle.

The weighting system with the container is calibrated to a reference value, for example 0 or minus the weight of the toner to be introduced. The motor for driving the roller of the peristaltic pump 5 is actuated (by pressing on a button "start"). The rollers, the one after the other acts on the portion 2C of the pipe so as to form a local flattened zone in said portion and so as to move downwardly said local flattened zone, whereby pushing the toner present in the portion 2C downwardly. The container 1 receives then the toner flowing out of the pipe through the outlet 2B. As soon as the weighting system detects that the required amount of toner is within the container or bottle TC, the weighting system sends a signal to the control system 8 for stopping the rotation of the pump 5.

The outlet 2B of the pipe is removed from the container TC and closed with the plug 4. The bottle TC is removed and closed with cap or a sealing means.

A new bottle TC is placed on the weighting system 7. After calibration, the plug is removed from the outlet 2B and said outlet is introduced in the bottle 1. The filling operation is then similar to that disclosed here above.

Figure 2:
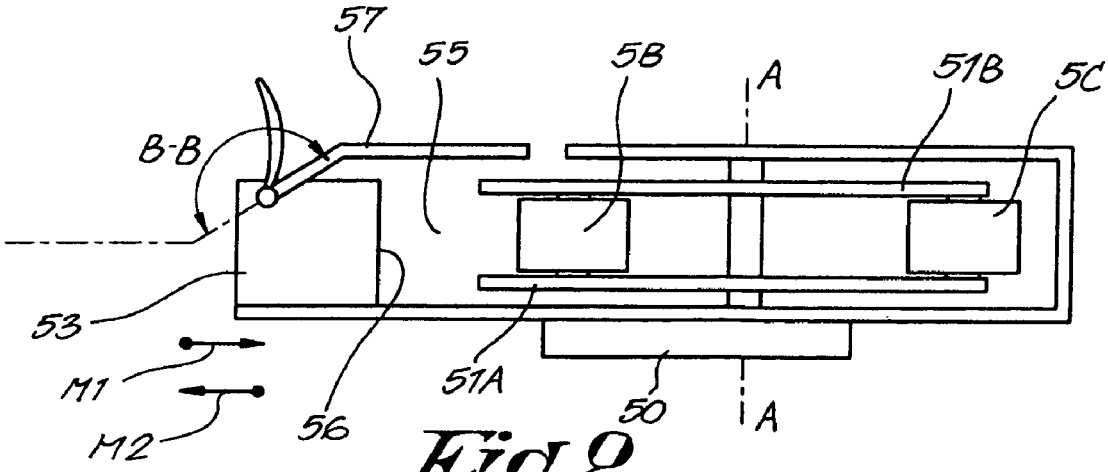
FIG. 2 is an enlarged side view of a peristaltic pump of a device similar to that shown in FIG. 1.

FIG. 2 is an enlarged view of a peristaltic pump 5 suitable for the device of FIG. 1.

The pump 5 comprises:

- a motor 50,
- a lower circular plate 51A and an upper circular plate 51B between which are placed the three rollers 5A,5B,5C, said plates being driven into rotation by the motor 50. The rollers are placed at equal distance from each others and at a same distance from the rotation axis A-A of the plates. The rollers are freely rotatable with respect to the circular plates.
- a box 52 in which are placed the circular plates and the rollers,
- a movable element 53 connected to the box so as to be able to move towards (arrow M1) the rollers (working position) after placement of the portion 2C in the channel 55 formed between the curved face 56 of the element facing the rollers, or to move backwards (arrow M2) from the rollers so as to facilitate the removal of the pipe portion 2C by increasing the width of the channel 55.
- a cover 57 mounted pivotable around the axis B-B with respect to the element 53, said cover being suitable for closing the front face of the channel 55 through which the pipe portion 2C is pushed.

Figure 3:
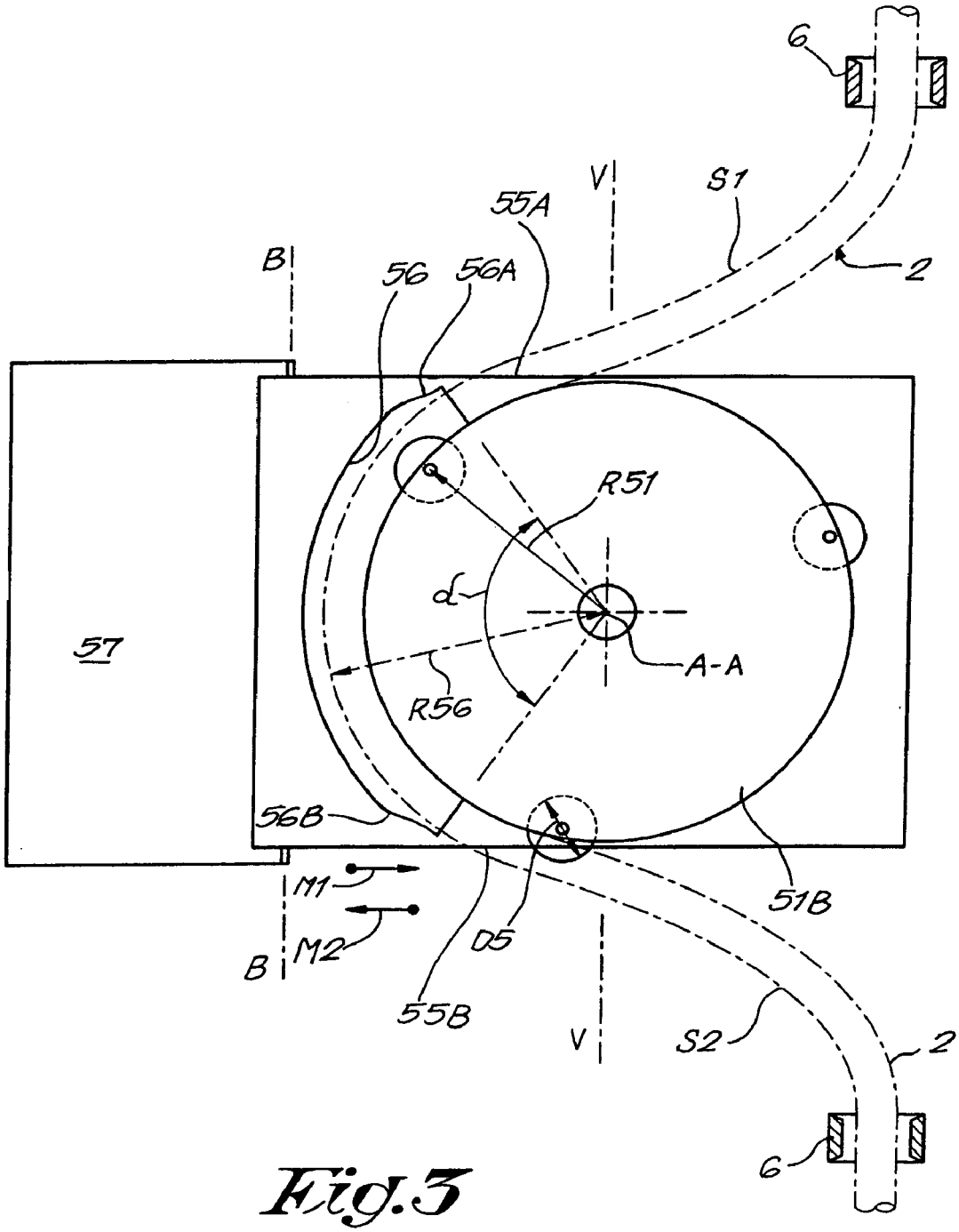
FIG. 3 is a enlarged view of the pump of FIG. 2, with the cover in open position and with partial cuts.

The channel 55 is shown in open position (larger width) in FIG. 3 by a continuous line, while the channel in working position is shown in dashed lines. The channel has an upper inlet opening 55A and a lower outlet opening 55B. In working position, at least one roller (for example 5A in the case as shown) exerts a pressure on a local section of the pipe so as to flatten said local portion. The relative position of the roller acting on the pipe and the face 56 varies during the rotation of the plates 51A,51B.

The rollers 5A,5B,5C are identical and have a diameter D5 of 0.5 cm to 2 cm, preferably about 0.7-1.2 cm. The distance R51 between the axis of rotation A-A and the axis of rotation C-C of the rollers is for example comprised between 2 cm and 8 cm, preferably between 2.5 cm and 5 cm.

In working position, the face 56 is curved, the curvature of which is centered with respect to the axis A-A and is defined by a radius of curvature R56 corresponding substantially to R51+(½×D5)+(2× thickness of the wall of the pipe), for example a radius of curvature comprised between 3 cm and 4.5 cm. The radius of curvature is preferably equal to 1.02 and 1.1×[R51+(½×D5)+(2× thickness of the wall of the pipe)] so as to not exert a too high pressure on particles still present on the wall of the local flattened zone of the pipe by the roller.

The pipe 2 has for example an outer diameter of about 1.2 cm and a thickness of about 2 mm (i.e. an inner diameter of 0.8 cm, and a ratio inner diameter/wall thickness of 4), said pipe being made in an elastic material, whereby the pipe can be elastically deformed or flattened. The pipe is advantageously transparent. Preferably the pipe is provided with an inner anti adherence coating, such as a fluoro coating, a teflon coating, etc. The pipe can also be made in an antiadherent material, such as in Teflon.

The face 56 extends between two ends 56A,56B along a portion of a circular path defined by an angle α comprised between 100 and 160°.

The ends 56A,56B are curved in a direction opposite to the direction of curvature of the central circular portion of the face 56.

The device comprises two maintaining means 6 one located at a level above the pump 5 (for example 10 to 25 cm above the pump 5), while the other is located at a level below the pump 5 (for example 10 to 25 cm below the pump). Said means 6 are distant from the vertical plane V passing through the axis A-A. The distance D6 separating the means 6 with respect to the plane is advantageously greater than the radius of curvature R56 of the face 56, for example comprised between 1.5 and 5 times said radius of curvature 56. In this way it is possible to ensure a slope S1 for the pipe 2 from the upper maintaining means 6 to the inlet 55A of the channel 55, said slope S1 having a minimum radius of curvature at least equal to R56, preferably 2 to 10 times said radius R56.

A slope S2 similar to the slope S1 is defined between the outlet 55B of the channel 55 and the lower maintaining means 6.

During the working of the pump 5, vibrations are transmitted to the pipe, whereby the slope S1 and S2 are moved so as to enable an improved flow of toner particles towards the pump 5 or towards the outlet 2B of the pipe.

Figure 4:
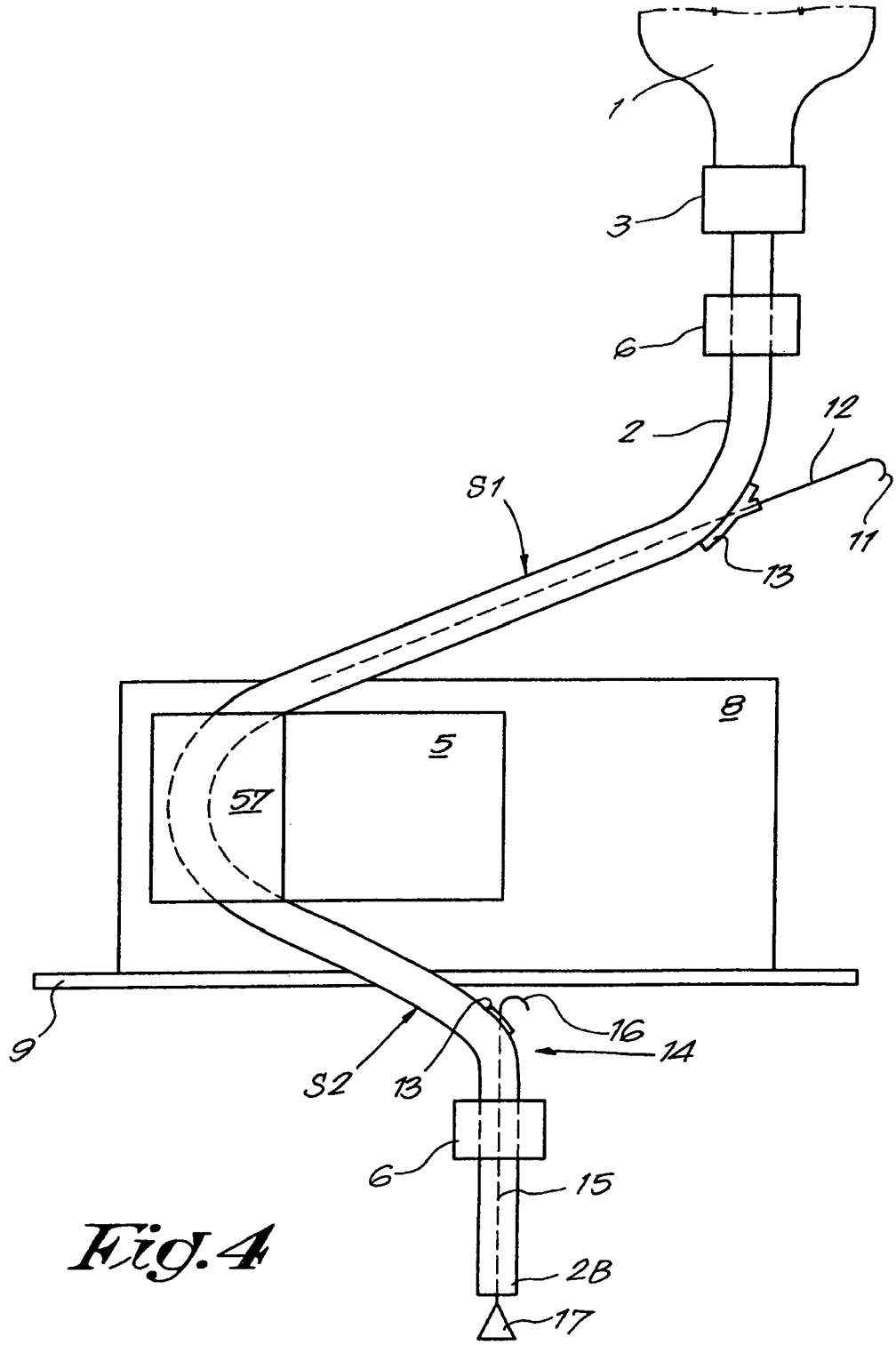
FIG. 4 is a view of a detail of an embodiment similar to that of FIG. 1.

FIG. 4 is a view of a possible path for the pipe 2, with maintaining means 6. In this embodiment the end portion of the pipe adjacent to the inlet 2A and the end portion of the pipe adjacent to the outlet 2B are not co-axial. In this embodiment, the slope portion S1 of the pipe 2 is provided with a means for breaking aggregates or for breaking a toner clog. Such a breaking or declogging means 11 is for example a wire 12 (iron or copper wire for example) traversing a wall of the pipe so that a portion of the pipe extends inside the pipe, while another portion extends outside the pipe so as to actuate a movement to said wire 12. In the embodiment shown, at the place where the wire is introduced, a toner collecting means 13 is placed so as to clean the portion of the wire removed from the pipe during the movement of the wire. Such a collecting means is for example a foam layer, a wiping element, carpet felt, etc.

In another embodiment, the pipe 2 is provided with an air inlet between the inlet 2A and the pump 5, said air inlet having the form of a hollow pipe with an outer diameter of less than 3 mm, especially less than 2 mm, such as an injection needle. Air is sucked by the underpressure created in section S1 of the pipe, said air breaking the toner clog. Advantageously the air flow can be regulated by changing the hole diameter of the needle or by a valve controlling the air inlet in said needle.

Such a breaking system is also advantageously used for breaking possible agglomerates in the end portion of the pipe adjacent to the outlet 2B. Said system 14 comprises a wire 15 extending partly in the pipe, said wire passing through a wall of the pipe (for example at a point located above the lower maintaining means 6) whereby a portion 16 of the wire extents outside of the pipe so as to form an actuating means. A collecting means 13 (such as a foam layer or a felt layer) is placed around the penetrating point of the wire 15 into the pipe. The lower end of the wire is provided with a plug 17, such as a conical plug. The plug is adapted for closing the outlet 2B of the pipe 2 at the end of a filling operation. The plug 17 during a filling operation is removed from the outlet 2B so as to enable a flow of toner in the container or bottle to be filled. Such a system is advantageous, as it enables a closing or opening of the outlet 2B while said outlet 2B is still in the container or pipe.

Figure 5:
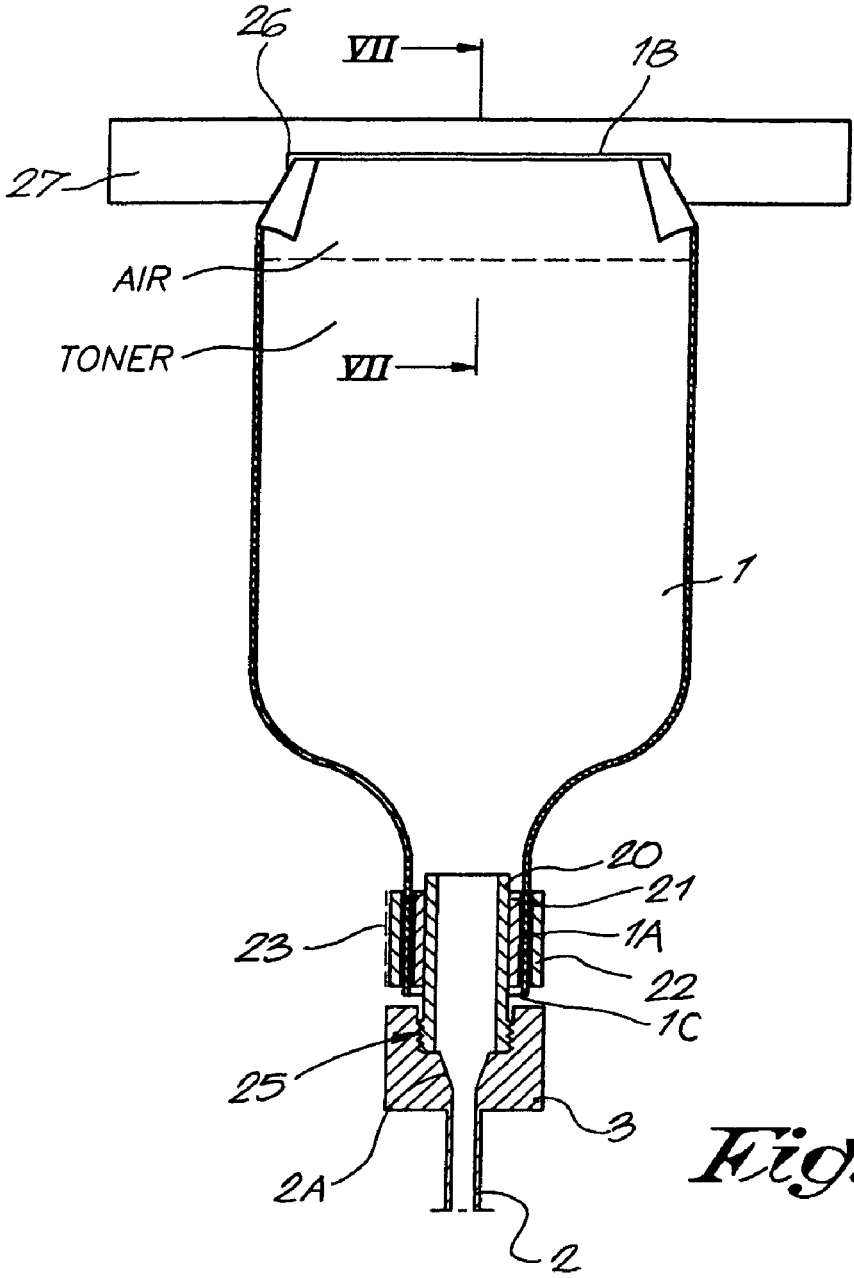
FIG. 5 is a view of a specific toner supply means.

FIG. 5 is a schematic view of a toner supplying means 1.

The toner supply is a flexible bag 1, the open end 2 of which is associated with a intermediate pipe 20 provided with a rubber layer 21. The pipe is placed partly in the bag, and the plastic portion 1A of the bag adjacent to the opening 1C is pressed against the rubber layer 21. An outer rubber layer 22 can possibly cover said pressed portion 1A of the bag, and rings 23 are fixed so as to exert a pressure on the rubber layers 21, 22, whereby a good sealing is obtained between the bag and the pipe. The pipe 20 is made in a material sufficiently rigid for resisting to the compression exerted by the rings 23.

The end of the pipe 20 is provided with a thread 24 adapted for working with the screw portion 25 of the connector 30 on which the inlet end 2A of the pipe 2 is fixed.

The bag 1 is advantageously attached on the structure 9, so that the open end 1A of the bag is directed downwards with respect to the bottom 1B of the bag. The bottom 1B of the bag is folded and engaged in a groove 26 of a cylinder 27. The bottom end is so enrolled so that said end is fixedly attached to the cylinder 27.

Advantageously, the bag 1 contains a limited amount of air or only a small portion of the inside of the bag is free of toner particles. During the filling operation, toner escapes from the bag 1, whereby the inner volume of the bag is reduced.

Figure 6:
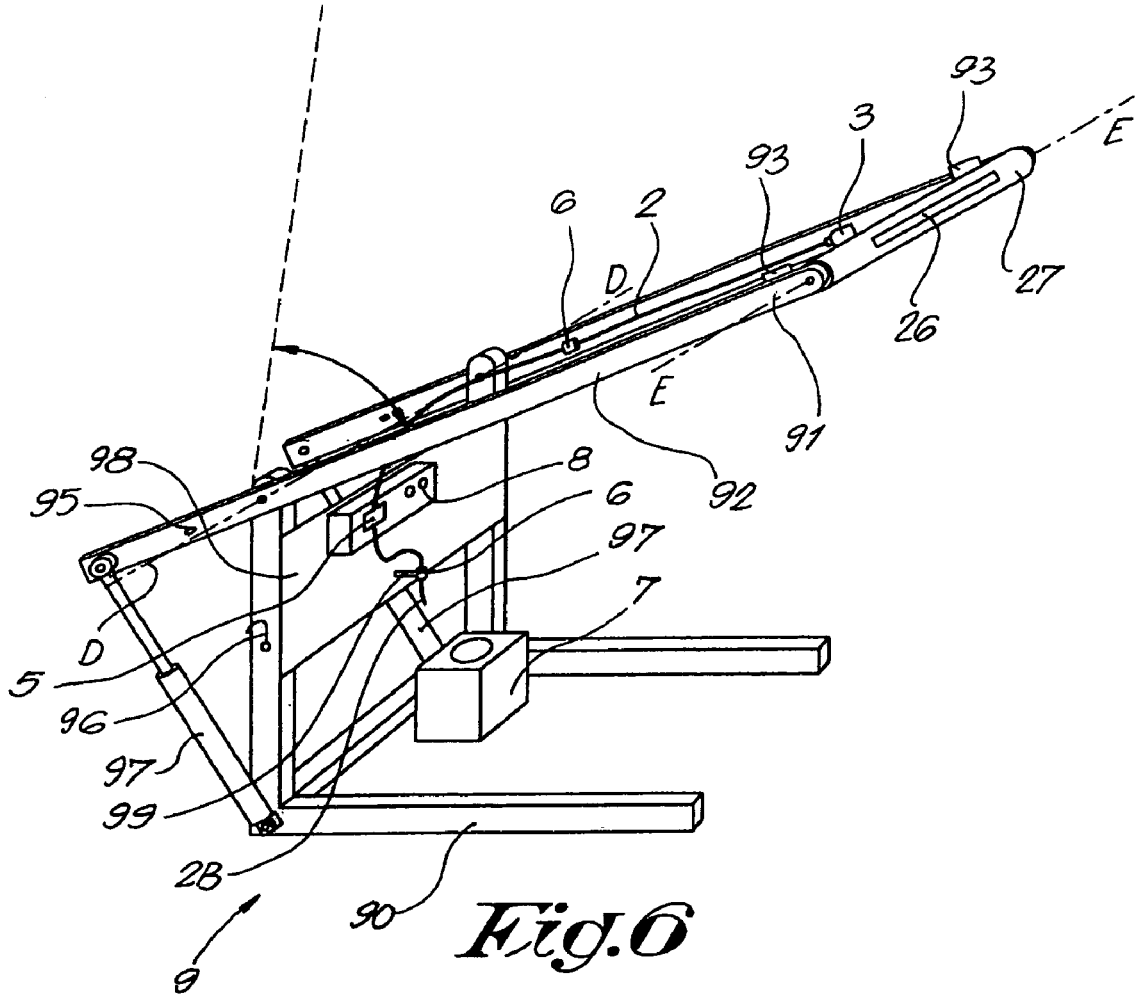
FIG. 6 is a view showing an advantageous structure for the device of the invention.

FIG. 6 is a perspective view of a structure 9 adapted for bearing a bag 1 as shown in FIG. 5. The structure comprises a base 90 on which is attached a mobile part 91 intended to bear the bag 1. The mobile part is able to pivot around the axis D-D between a position in which the end of the part 91 bearing the cylinder 27 with the groove opening 26 is lowered (position shown in FIG. 6), and a position in which the part 91 is substantially vertical (position shown in dashed line). When lowering the part 91 (by pivoting it), it is easier to remove an empty bag or to replace it with a new bag or to place a new bag, as the operator can easily introduce the bottom of the bag into the passage and to roll said end so as to fix the bottom bag correctly on the cylinder 27. The arms 92 of the part 91 are provided with stopping means 93 for maintaining the cylinder in position after enrolling the bottom part of the bag. Such stopping means are for example means for blocking the cylinder whereby said cylinder 27 can no more pivot around its axis E-E.

The arms 92 are provided with extensions 94 with a connecting element 95 adapted for working with an attachment means 96 (such as a hook mechanism) so as to maintain the part 91 substantially vertical. A cylinder 97 or another mechanism (such a spring, a gas spring, etc.) can be used for limiting the pivoting angle of the part 91 with respect to the base 90. The cylinder or gas spring 97 is also suitable for reducing the lifting force required for placing back the part 91 in its upper position.

A maintaining ring 6 is attached to an arm 92 so as to maintain locally a portion of the pipe.

The base 90 is provided with a plate 98 on which is fixed the control system 8 with the peristaltic pump 5, as well as a profile 99 with the ring 6 adapted for maintaining another portion of the pipe 2.

The device 7 for weighting the bottle or container during its filling is advantageously independent from the base.

When the weighting mechanism is attached directly to the base, it is advantageous to provide some absorbing means so as to limit the vibrations of the weighting mechanism.

Figure 7:
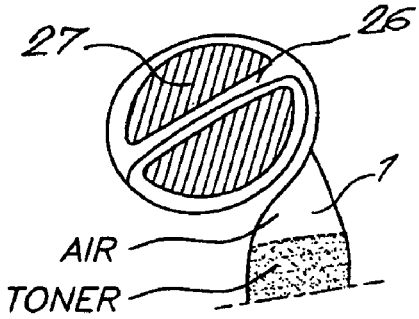
FIG. 7 is a cross section view of a portion of the supply means of FIG. 5 along the line VII-VII.

FIG. 7 is a cross section view of the cylinder of FIG. 5.

Figure 8:
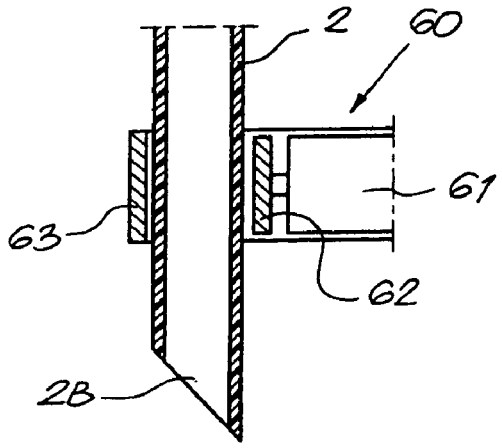
FIGS. 8 and 9 are views of a means for closing the pipe adjacent to its outlet, in its open position and its closed position.
Figure 9:
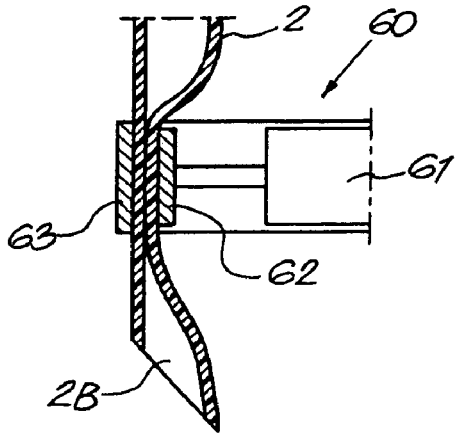

FIGS. 8 and 9 are views of a specific system 60 for interrupting the flow of toner towards the outlet 2B of the pipe. Said system comprises a cylinder 61 suitable for pushing a plate 62 towards the plate 63 so as to flatten the pipe 2 between said plates 62 and 63. When toner has to flow towards the end 2B, the cylinder is then actuated so to place away the plates, whereby the pipe due to its elasticity recover its normal form. Such a cylinder can be actuated pneumatically.

Figure 10:
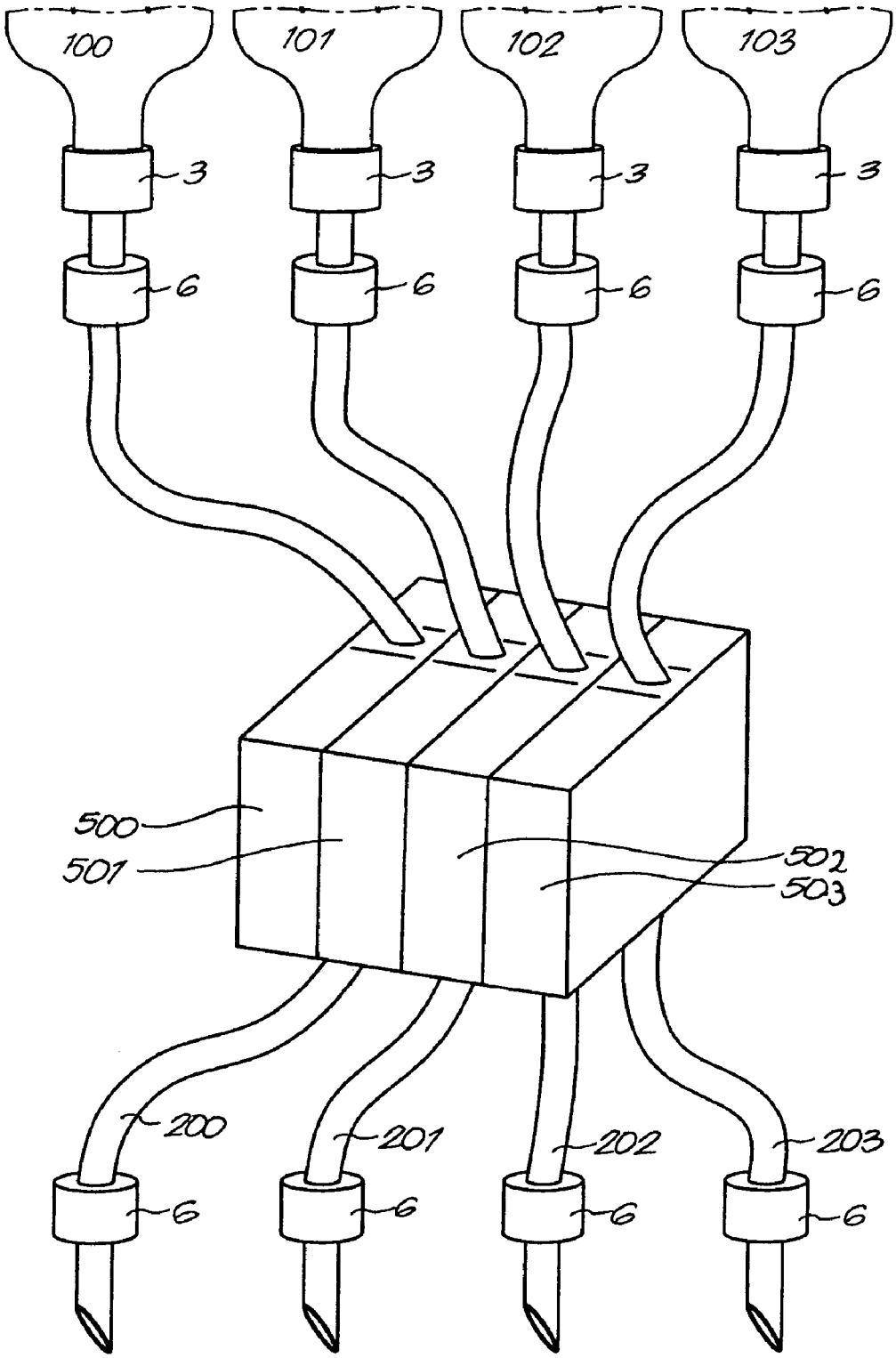
FIG. 10 is a schematic view of a device comprising several pumps.

FIG. 10 shows schematically a part of a device similar to that shown in FIG. 1, except that the device comprises a series of peristaltic pumps 500, 501, 502, 503 cooperating respectively with the elastic flexible pipe 200, 201, 202, 203. Each pipe is connected to a different supply means 100, 101, 102, 103. When the pumps are actuated simultaneously it is possible to fill four different containers. When only one pump of the series can be operated alone, the operator can select the pump to be actuated for filling the container with one specific toner, for example a toner with a specific color. A multiple head pump can also be used if a faster filling is required.

Figure 11:
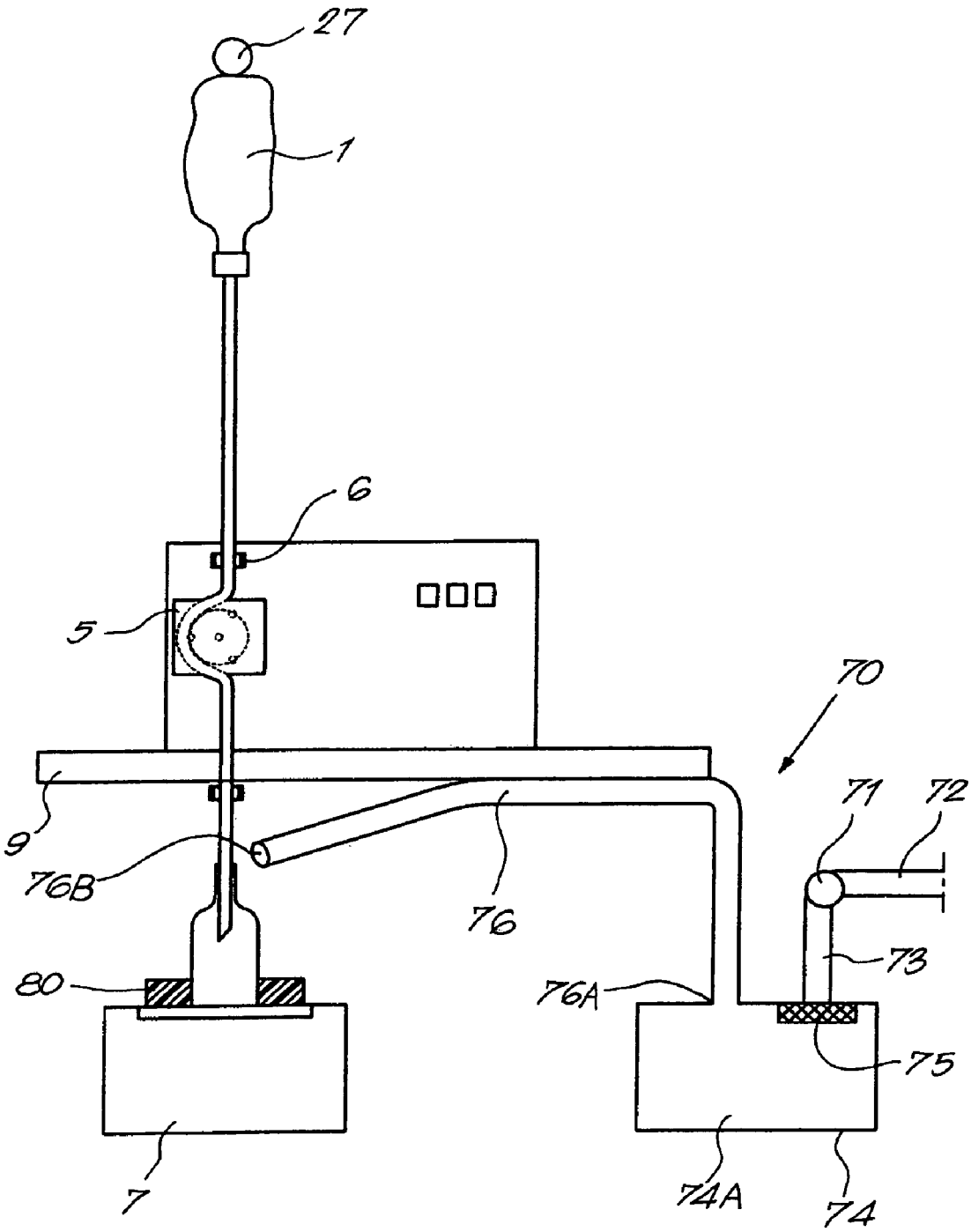
FIG. 11 is a view of a device for collecting toner dust.

FIG. 11 is a schematic view of a detail of an embodiment of a device similar to that shown in FIG. 1. In said embodiment, the device is provided with a system sucking toner particles escaping from the bottle neck or container to be filled. The sucking system 70 comprises:

- a ventilator or a turbine 71 expelling air in the tube 72 and sucking air from the tube 73,
- a dust collecting means 74 with a collecting chamber 74A and a filter element 75 at the outlet said outlet being connected to the tube 73, and
- a sucking tube 76 having a first end 76A connected to the inlet of the dust collecting means (more precisely to the chamber 74A) and an sucking inlet 76B placed adjacent to the opening of the container or bottle to be filled.

Figure 12:
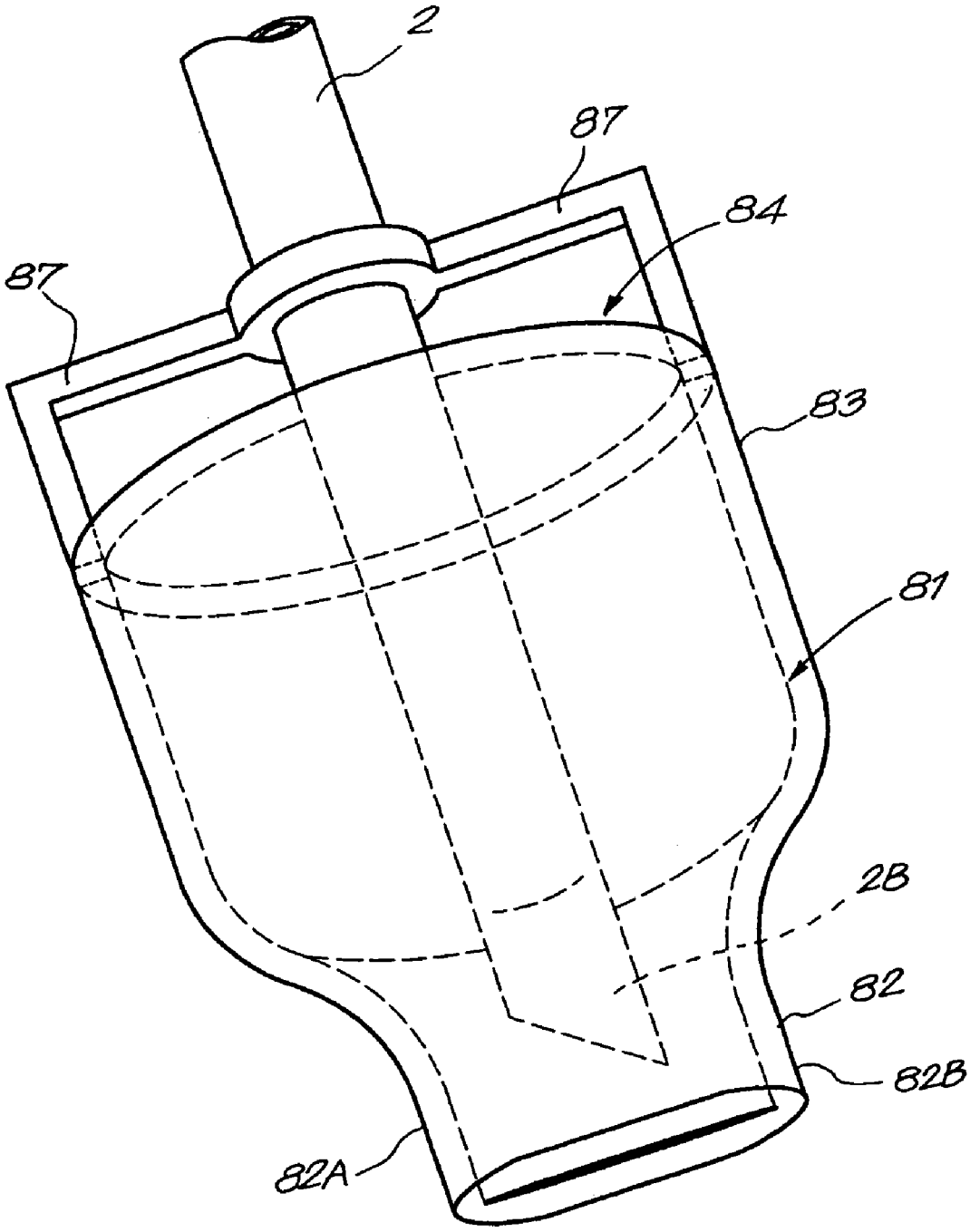
FIGS. 12 and 13 are views of another device for collecting toner dust.
Figure 13:
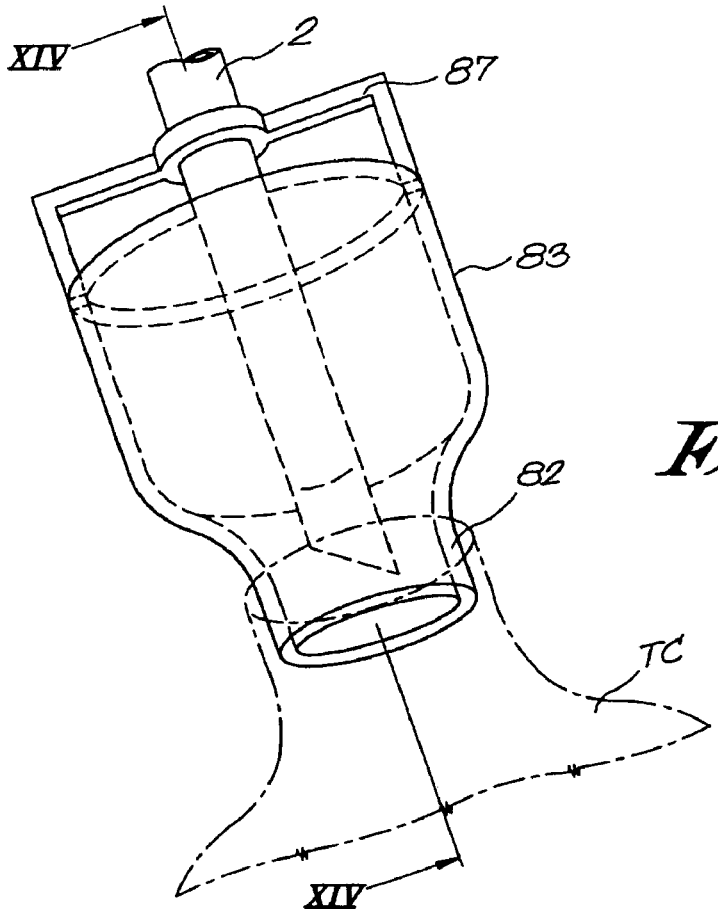

FIGS. 12 and 13 are schematic view of a collecting means acting also as closing means for the outlet 2B of the pipe 2. The collecting means 81 is made of a rubber like material and comprises a tip portion 82 and an enlarged portion 83. The enlarge portion is substantially cylindrical and form an inner collecting chamber 84. The tip portion 82 is flat in its normal position, while when a pressure is exerted between its edges 82A,82B, the tip has a substantially cylindrical form, whereby defining a channel 86 connected to the collecting chamber 84. The pipe is attached to the collecting means by the connecting arms 87. The outlet of the pipe 2 is located in the collected means 81, so that it extends at the level of the tip portion 82, whereby when no pressure is exerted on the lateral edges 82A,82B of the flattened tip 82, the outlet 2B of the pipe is in close contact with the inner face of the tip, so that the outlet 2B is closed. When a pressure is exerted on the lateral edges 82A,82B, the outlet pipe is no more in contact with the inner face of the tip portion 82, whereby the flow of toner particles is possible for filling the toner container TC.

Figure 14:
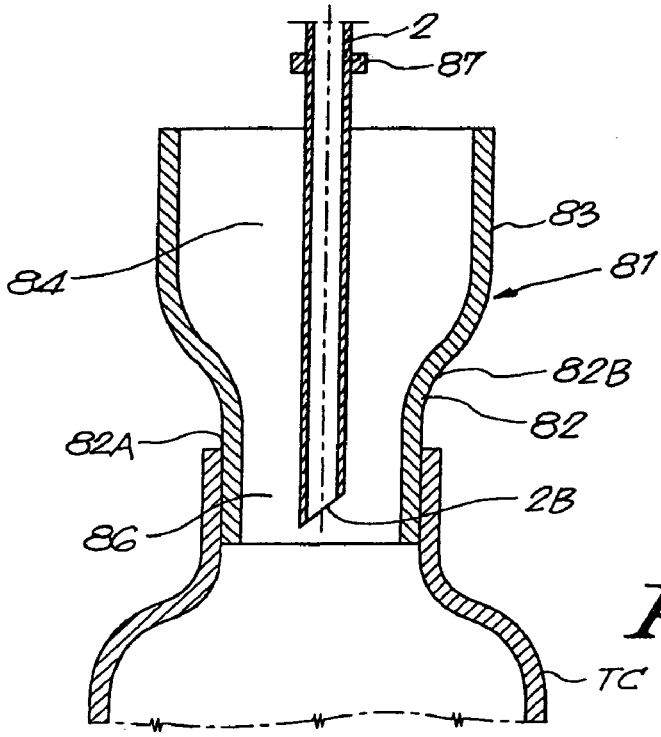
FIG. 14 is a cross section view along the line XIV-XIV of the collecting means of FIG. 13.

FIG. 14 is a cross section view of the collecting means shown in FIG. 13. The open position of the tip portion 82 is ensured by the contact of the edges 82A,82B on the inner wall of the opening of the toner container TC.

Figure 15:
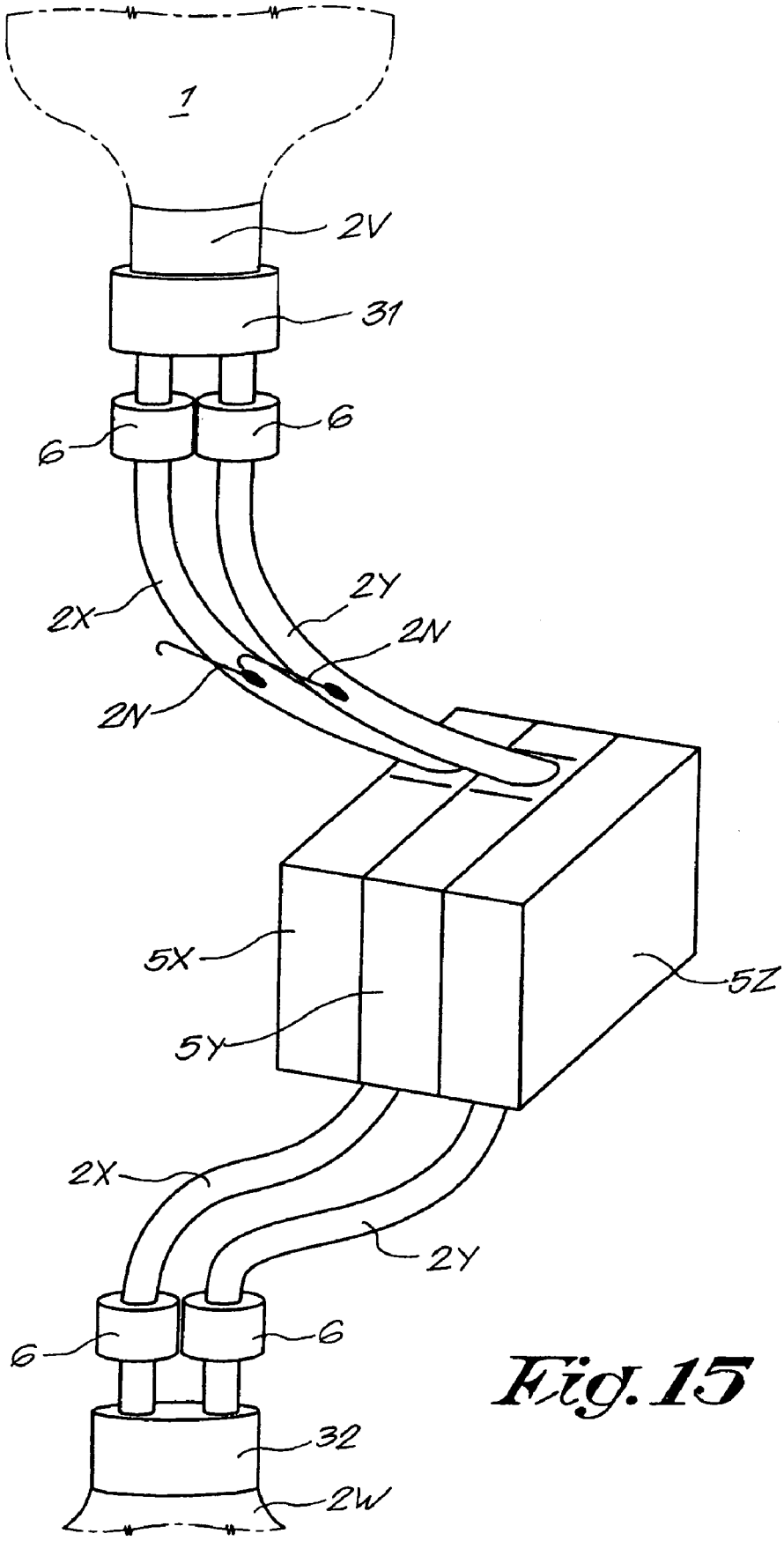
FIG. 15 is a schematic view of a detail of a further device of the invention similar to that of FIG. 1.

FIG. 15 is a view of a detail of an embodiment similar to that of FIG. 1.

The piping system comprises two flexible and compressible pipe portions 2X,2Y, the inlets of which are connected via the connector 31 to the pipe 2V connected to the toner supplying means 1, while the outlet of which are connected to the outlet pipe 2W via the connector 32.

Each pipe portions 2X,2Y are partly placed in a pump 5X,5Y, said pumps being driven by one single motor 5Z. The tow pumps 5X,5Y press the pipe portions 2X,2Y, whereby creating in each pipe portion a flow of dry toner particles. The flow of dry particles from the pipe 2X,2Y is then collected in the outlet pipe 2W.

Such a device is advantageous for increasing the flow rate of toner particles.

Each pipe portion 2X,2Y is provided with a needle 2N so as to enable the suction of air in the pipes.

Figure 16:
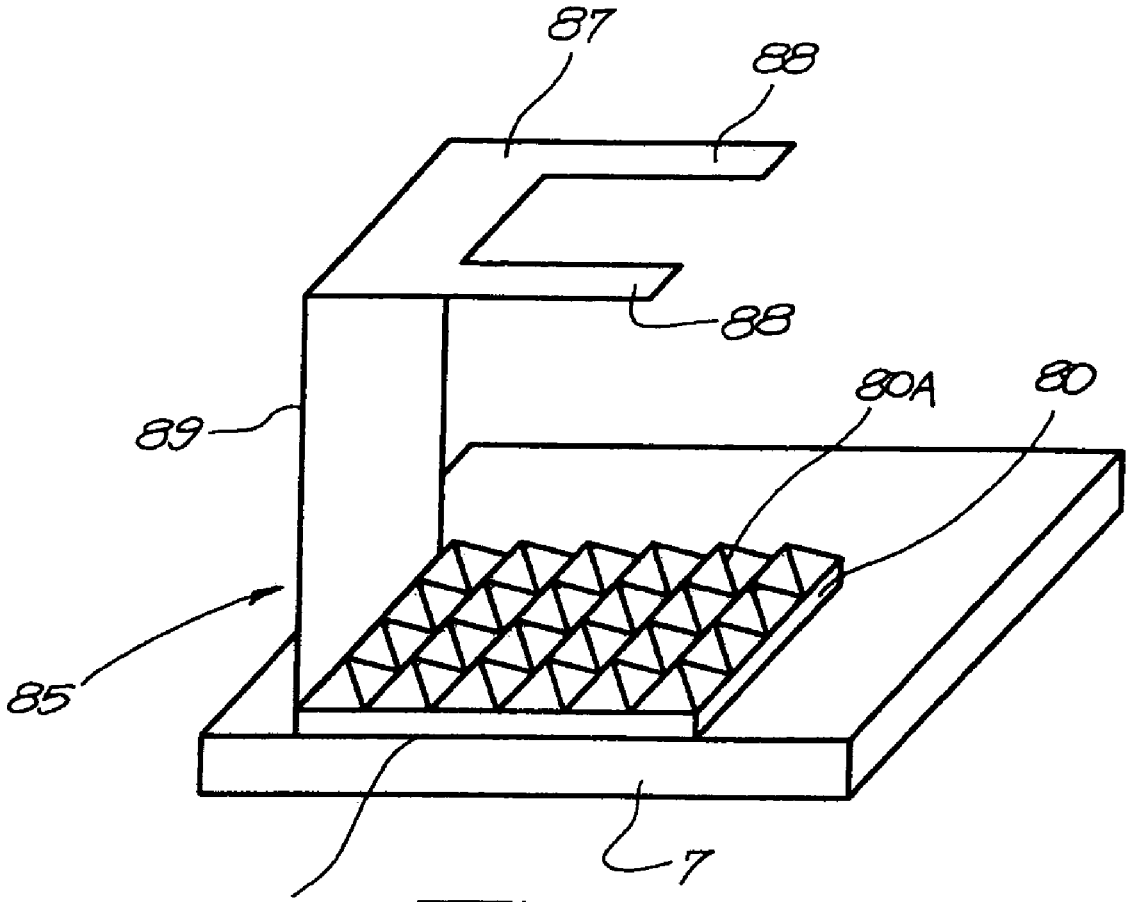
FIG. 16 is a schematic perspective view of a system for maintaining in position the container during its filling.

FIG. 16 is a schematic perspective view of a support 7 provided with a foam layer 80. The support comprises a folded plate 85 comprising a base plate 86, a top plate 87 with two arms 88, and an intermediate plate 89 extending between the base plate and the top plate. The base plate is provided with a foam layer 80, said foam layer having on its top face a series of protuberances 80A distant the one from the other by valleys. The base of the container to be filled is pressed on the foam layer, so as to place the top portion of the container between the arms 88. The foam exerts a force pushing the top portion of the container to be filled against the arms, whereby the container is maintained in position.

What we claim is:

1. Device for filling dry toner powder from a supplying means in a toner container, said device comprising:

- a piping system comprising at least a flexible and compressible pipe, said piping system having an inlet adapted to be connected to the supplying means for enabling a flow of toner powder from the supplying means and an outlet,
- at least one means for maintaining at least one portion of the piping system so that the outlet is at a level situated below the inlet and for maintaining the piping system from the inlet to the outlet in a continuous downwards path, at least one compressing means for compressing a portion of the flexible and compressible pipe, and at least one means for ensuring a relative movement between the compressing means and the portion to be compressed of the flexible and compressible pipe so as to create a pushing of the toner present in said portion towards the outlet.

2. The device of claim 1, in which the means for compressing a portion of the pipe comprises at least one roller.

3. The device of claim 1, in which the means for compressing a portion of the pipe comprises at least two rollers.

4. The device of claim 1, in which the means for compressing a portion of the pipe comprises at least three rollers.

5. The device of claim 1, in which the portion of the pipe to be compressed extends between a first transversal section and a second transversal section, whereby the device comprises means for maintaining curved the portion between said first and second transversal sections, so that said curved portion has a minimum radius of curvature of at least 1 cm.

6. The device of claim 1, in which the portion of the pipe to be compressed extends between a first transversal section and a second transversal section, whereby the device comprises means for maintaining curved the portion between said first and second transversal sections, so that said curved portion has a minimum radius of curvature comprised between 1.5 cm and 10 cm.

7. The device of claim 1, in which the portion of the pipe to be compressed is curved so as to form a portion of a circular path, said portion extending on an angle of less than 200°.

8. The device of claim 1, in which the portion of the pipe to be compressed is curved so as to form a portion of a circular path, said portion extending on an angle of less than 181°.

9. The device of claim 1, in which the portion of the pipe to be compressed is curved so as to form a portion of a substantially circular path, said portion extending on an angle of less than 180°.

10. The device of claim 1, in which the portion of the pipe to be compressed is curved so as to form a portion of a substantially circular path, said portion extending on an angle comprised between 45° and 175°.

11. The device of claim 1, in which the portion of the pipe to be compressed is curved so as to form a portion of a substantially circular path, said portion extending on an angle comprised between 100 and 160°.

12. The device of claim 1, in which the pipe comprises:

a first curved portion intended to be compressed, a second curved portion located between the first curved portion and the inlet, and a third curved portion located between the first curved portion and the outlet.

13. The device of claim 1, in which the pipe comprises:

a first curved portion intended to be compressed, a second curved portion located between the first curved portion and the inlet, and a third curved portion located between the first curved portion and the outlet, whereby the second and third curved portions are adjacent to the first curved portion.

14. The device of claim 13, in which the first curved portion, the second curved portion and the third curved portion are located substantially in a same vertical plane.

15. The device of claim 1, in which the pipe comprises:

a first curved portion intended to be compressed, said first portion having a bending in a first direction a second curved portion located between the first curved portion and the inlet, and a third curved portion located between the first curved portion and the outlet, whereby the second and third curved portions are adjacent to the first curved portion and have a bending in a direction opposite to the first direction.

16. The device of claim 1, in which the pipe comprises:

a first curved portion intended to be compressed, said first portion having a bending in a first direction, a second portion adjacent to the inlet, a third curved portion located between the first curved portion and the second portion, a fourth portion adjacent to the outlet, and a fifth curved portion located between the first curved portion and the fourth portion, whereby the third and fifth curved portions are adjacent to the first curved portion and have a bending in a direction opposite to the first direction.

17. The device of claim 16, in which the second portion and the fourth portion are substantially vertical.

18. The device of claim 17, in which the second portion and the fourth portion extend substantially along a same vertical axis.

19. The device of claim 1, which comprises a means for exerting vibration to the pipe.

20. The device of claim 1, in which the means for ensuring a relative movement between the compressing means and the portion to be compressed so as to create a pushing of the toner present in said portion towards the outlet is also a means for exerting vibration to the pipe.

21. The device of claim 1, which comprises a peristaltic pump acting as a compressing means of a portion of the pipe and as a means for ensuring a relative movement between the compressing means and the portion to be compressed so as to create a pushing of the toner present in said portion towards the outlet.

22. The device of claim 1, which comprises a peristaltic pump acting on a portion of the pipe, and maintaining means for maintaining two portions of the pipe distant from the portion on which acts the peristaltic pump, whereby said maintaining means are adapted so as to enable a movement of the pipe during the working of the peristaltic pump, whereby said peristaltic pump acts as a compressing means of a portion of the pipe and as a means for ensuring a relative movement between the compressing means and the portion to be compressed so as to create a pushing of the toner present in said portion towards the outlet.

23. The device of claim 1, which comprises a connecting piece attached to the pipe, said connecting piece being adapted for connecting the inlet of the pipe to a supplying means.

24. The device of claim 23, in which the connecting piece is adapted for ensuring a substantially complete sealing.

25. The device of claim 1, which comprises a drum as supplying means.

26. The device of claim 1, which comprises a connecting piece attached to the pipe, said connecting piece being adapted for connecting the inlet of the pipe to a supplying means made of a flexible and compressible material.

27. The device of claim 1, which comprises a connecting piece attached to the piping system, said connecting piece being adapted for connecting the inlet of the piping system to a supplying means made of a flexible and compressible bag.

28. The device of claim 1, in which the piping system comprises a flexible pipe provided with a connecting piece, said connecting piece being adapted for connecting the inlet of the pipe to a supplying means made of a flexible and compressible bag.

29. The device of claim 1, which comprises a supporting means adapted for supporting a toner supplying means at a level above the compressing means.

30. The device of claim 1, which comprises a supporting means adapted for supporting a toner supplying means in a form of a flexible and compressible bag at a level above the compressing means.

31. The device of claim 1, which comprises a supporting means adapted for supporting a toner supplying means in a form of a flexible and compressible bag at a level above the compressing means, said supporting means being adapted for enabling a relative movement of the bag with respect to the supporting means.

32. The device of claim 1, in which a flexible and compressible pipe has an inner equivalent diameter of less than 2 cm.

33. The device of claim 1, in which a flexible and compressible pipe has an inner equivalent diameter of less than 1.5 cm.

34. The device of claim 1, in which a flexible and compressible pipe has an inner equivalent diameter greater than 0.4 cm.

35. The device of claim 1, in which a flexible and compressible pipe has an inner equivalent diameter comprised between 0.6 and 1.5 cm.

36. The device of claim 1, which is provided with a control means so that the maximum flow of toner particles is lower than 3 kg per minute.

37. The device of claim 1, which is provided with a control means so that the maximum flow of toner particles is lower than 2 kg per minute.

38. The device of claim 1, which is provided with a control means so that the maximum flow of toner particles is comprised between 0.1 kg and 1.6 kg per minute.

39. The device of claim 1, which comprises a peristaltic pump acting as a compressing means of a portion of the pipe and as a means for ensuring a relative movement between the compressing means and the portion to be compressed so as to create a pushing of the toner present in said portion towards the outlet, whereby said peristaltic pump comprises at least three rollers adapted for compressing a curved portion of the pipe, whereby said portion is located with respect to the peristaltic pump so that a roller starts to exert a pressure on said portion, while another roller exerts a pressure on the pipe so as to compress it only partly.

40. The device of claim 1, which comprises a peristaltic pump acting as a compressing means of a portion of the pipe and as a means for ensuring a relative movement between the compressing means and the portion to be compressed so as to create a pushing of the toner present in said portion towards the outlet, whereby said peristaltic pump comprises at least three rollers adapted for compressing a curved portion of the pipe, whereby said portion is located with respect to the peristaltic pump so that a roller starts to exert a pressure on said portion, while another roller exerts substantially no pressure on the pipe.

41. The device of claim 1, which comprises a structure with a supporting means adapted for supporting a toner supplying means, whereby said supporting means is mounted mobile with respect to the toner supplying means.

42. The device of claim 1, which comprises a wire mounted at least partly mobile in the pipe so as to break toner agglomerates.

43. The device of claim 1, which comprises at least an air inlet means for introducing air in the pipe between the means for compressing a portion of the pipe and the inlet.

44. The device of claim 1, in which the flexible and compressible pipe portion to be compressed has a wall thickness comprised between 0.1 and 1 cm.

45. The device of claim 1, in which the flexible and compressible pipe portion to be compressed has an inner diameter and a wall thickness comprised between 0.1 and 1 cm, whereby the ratio wall thickness/inner diameter is comprised between 1:5 and 1:2.

46. The device of claim 1, in which the flexible and compressible pipe portion to be compressed has an inner diameter and a wall thickness comprised between 0.1 and 1 cm, whereby the ratio wall thickness/inner diameter is comprised between 1:4.5 and 1:3.5.

47. Device for filling toner powder from a supplying means in a toner container, said device comprising:

several flexible and compressible pipes with an inlet adapted to be connected to the supplying means for enabling a flow of toner powder from the supplying means and with an outlet, at least one maintaining means for maintaining at least one portion of each pipe so that the outlet of a pipe is at a level situated below the inlet of said pipe and for maintaining each pipe from the inlet to the outlet in a continuous downwards path, compressing means for compressing a portion of each pipe, and moving means for ensuring for each pipe a relative movement between the compressing means and the portion to be compressed so as to create a pushing of the toner present in said portion towards the outlet.

48. The device of claim 47, which comprises several peristaltic pumps as compressing and moving means.

49. Device for filling toner powder from at least one supplying means in a toner container, said device comprising:

several piping systems comprising each a flexible and compressible pipe, each piping system having an inlet adapted to be connected to a supplying means for enabling a flow of toner powder from the supplying means and an outlet, at least one maintaining means for maintaining at least one portion of each piping system so that the outlet of a piping system is at a level situated below the inlet of said piping system and for maintaining each piping system from the inlet to the outlet thereof in a continuous downwards path, compressing means for compressing a portion of each pipe, and moving means for ensuring for each pipe a relative movement between the compressing means and the portion to be compressed so as to create a pushing of the toner present in said portion towards the outlet.

50. Device for filling toner powder from a supplying means in a toner container, said device comprising:

a piping system comprising several flexible and compressible pipes mounted in parallel, said piping system comprising an inlet adapted to be connected to the supplying means for enabling a flow of toner powder from the supplying means and with an outlet, at least one maintaining means for maintaining at least one portion of the piping system so that the outlet of a piping system is at a level situated below the inlet of said piping system and for maintaining each piping system form the inlet to the outlet thereof in a continuous downwards path, compressing means for compressing a portion of each pipe, and moving means for ensuring for each pipe a relative movement between the compressing means and the portion to be compressed so as to create a pushing of the toner present in said portion towards the outlet.

51. A process for filling a toner container with toner particles issuing from a toner supplying means by means of a filling device, said device comprising at least:

a piping system comprising at least a flexible and compressible pipe, said piping system having at least an inlet adapted to be connected to the supplying means for enabling a flow of toner powder from the supplying means and an outlet, at least one means for maintaining at least one portion of the piping system so that the outlet is at a level situated below the inlet and for maintaining the piping system form the inlet to the outlet thereof in a continuous downwards path, at least one compressing means for compressing a portion of the flexible and compressible pipe, and at least one means for ensuring a relative movement between the compressing means and the portion of the pipe to be compressed so as to create a pushing of the toner present in said portion towards the outlet, in which at least one compressing means is moved for compressing the pipe and in which, while the compressing means is compressing at least a portion of the pipe, a relative movement between the compressing means and the pipe is ensured so as to push toner particles towards the outlet.

52. The process of claim 51, in which the means for compressing a portion of the pipe comprises at least one roller.

53. The process of claim 51, in which the means for compressing a portion of the pipe comprises at least two rollers.

54. The process of claim 51, in which the means for compressing a portion of the pipe comprises at least three rollers.

55. The process of claim 51, in which the portion of the pipe to be compressed extends between a first transversal section and a second transversal section, whereby in the process, the portion between said first and second transversal sections is maintained curved, so that said curved portion has a minimum radius of curvature of at least 1 cm.

56. The process of claim 51, in which the portion of the pipe to be compressed extends between a first transversal section and a second transversal section, whereby the portion between said first and second transversal sections is maintained curved, so that said curved portion has a minimum radius of curvature comprised between 1.5 cm and 10 cm.

57. The process of claim 51, in which the portion of the pipe to be compressed is curved so as to form a portion of a circular path, said portion extending on an angle of less than 200°.

58. The process of claim 51, in which the portion of the pipe to be compressed is curved so as to form a portion of a circular path, said portion extending on an angle of less than 181°.

59. The process of claim 51, in which the portion of the pipe to be compressed is curved so as to form a portion of a circular path, said portion extending on an angle of less than 180°.

60. The process of claim 51, in which the portion of the pipe to be compressed is curved so as to form a portion of a circular path, said portion extending on an angle comprised between 45 and 175°.

61. The process of claim 51, in which the portion of the pipe to be compressed is curved so as to form a portion of a circular path, said portion extending on an angle comprised between 100 and 160°.

62. The process of claim 51, in which a flexible and compressible pipe having an inner equivalent diameter of less than 2 cm is used.

63. The process of claim 51, in which a flexible and compressible pipe having an inner equivalent diameter of less than 1.5 cm is used.

64. The process of claim 51, in which a flexible and compressible pipe having an inner equivalent diameter of greater than 0.4 cm is used.

65. The process of claim 51, in which a flexible and compressible pipe having an inner equivalent diameter of comprised between 0.6 and 1.5 cm is used.

66. The process of claim 51, in which the maximum flow of toner particles in the toner container is controlled so as to be lower than 3 kg per minute.

67. The process of claim 51, in which the maximum flow of toner particles in the toner container is controlled so as to be lower than 2 kg per minute.

68. The process of claim 51, in which the maximum flow of toner particles in the toner container is controlled so as to be comprised between 0.1 kg and 1.6 kg per minute.

69. The process of claim 51, in which the pipe comprises:

a first curved portion intended to be compressed, a second curved portion located between the first curved portion and the inlet, and a third curved portion located between the first curved portion and the outlet.

70. The process of claim 51, in which the pipe comprises:

a first curved portion intended to be compressed, a second curved portion located between the first curved portion and the inlet, and a third curved portion located between the first curved portion and the outlet, whereby the second and third curved portions are adjacent to the first curved portion.

71. The process of claim 70, in which the first curved portion, the second curved portion and the third curved portion are located substantially in a same vertical plane.

72. The process of claim 51, in which the pipe comprises:

a first curved portion intended to be compressed, said first portion having a bending in a first direction a second curved portion located between the first curved portion and the inlet, and a third curved portion located between the first curved portion and the outlet, whereby the second and third curved portions are adjacent to the first curved portion and have a bending in a direction opposite to the first direction.

73. The process of claim 51, in which the pipe comprises:

a first curved portion intended to be compressed, said first portion having a bending in a first direction, a second portion adjacent to the inlet, a third curved portion located between the first curved portion and the second portion, a fourth portion adjacent to the outlet, and a fifth curved portion located between the first curved portion and the fourth portion, whereby the third and fifth curved portions are adjacent to the first curved portion and have a bending in a direction opposite to the first direction.

74. The process of claim 73, in which the second portion and the fourth portion are substantially vertical.

75. The process of claim 74, in which the second portion and the fourth portion extend substantially along a same vertical axis.

76. The process of claim 51, in which during a filling operation the pipe is submitted at least partly to vibrations.

77. The process of claim 51, in which the means for ensuring a relative movement between the compressing means and the portion to be compressed creates a pushing of the toner present in said portion towards the outlet and exerts vibrations to the pipe.

78. The process of claim 51, in which a peristaltic pump acts as a compressing means of a portion of the pipe and as a means for ensuring a relative movement between the compressing means and the portion to be compressed so as to create a pushing of the toner present in said portion towards the outlet.

79. The process of claim 51, in which a peristaltic pump acts on a first portion of the pipe, while two portions of the pipe distant from the portion on which acts the peristaltic pump are maintained at least partly in position so as to enable a movement of the pipe during the working of the peristaltic pump, whereby said peristaltic pump acts as a compressing means of a portion of the pipe and as a means for ensuring a relative movement between the compressing means and the first portion to be compressed so as to create a pushing of the toner present in said first portion towards the outlet.

80. The process of claim 51, in which the piping system is connected to a toner supplying means by a connecting piece.

81. The process of claim 80, in which the connecting piece ensures a substantially complete sealing between the piping system and the toner supplying means.

82. The process of claim 51, in which a flexible and compressible bag is used as toner supplying means, said flexible and compressible bag being connected to the pipe by means of a connecting piece.

83. The process of claim 51, in which the toner supplying means is supported so as to extend at a level above the compressing means.

84. The process of claim 51, in which during a filling operation, possible toner particles escaping out of the toner container are collected in a collecting means adjacent to the outlet of the pipe.

85. The process of claim 51, in which the filling operation of a toner container is controlled so as to detect when the toner container is filled.

86. The process of claim 51, in which a valve adjacent to the outlet of the pipe is controlled at least at the end of a filling operation.

87. The process of claim 51, in which a valve at the outlet of the pipe is controlled at least at the end of a filling operation.

88. The process of claim 51, in which a peristaltic pump acts as a compressing means of a portion of the pipe and as a means for ensuring a relative movement between the compressing means and the portion to be compressed so as to create a pushing of the toner present in said portion towards the outlet, whereby the peristaltic pump is adjacent to the outlet of the pipe.

89. The process of claim 51, in which a pipe with anti adherence properties for toner particles is used.

90. The process of claim 51, in which a peristaltic pump is used as a compressing means of a portion of the pipe and as a means for ensuring a relative movement between the compressing means and the portion to be compressed so as to create a pushing of the toner present in said portion towards the outlet, whereby said peristaltic pump comprises at least three rollers adapted for compressing a curved portion of the pipe, whereby said portion is located with respect to the peristaltic pump so that a roller starts to exert a pressure on said portion, while another roller exerts a pressure on the pipe so as to compress it only partly.

91. The process of claim 51, in which a peristaltic pump is used as a compressing means of a portion of the pipe and as a means for ensuring a relative movement between the compressing means and the portion to be compressed so as to create a pushing of the toner present in said portion towards the outlet, whereby said peristaltic pump comprises at least three rollers adapted for compressing a curved portion of the pipe, whereby said portion is located with respect to the peristaltic pump so that a roller starts to exert a pressure on said portion, while another roller exerts substantially no pressure on the pipe.

92. The process of claim 51, in which a structure with a supporting means adapted for supporting a toner supplying means is used, whereby said supporting means is mourned mobile with respect to the structure, and in which the supporting means is moved with respect the structure at least for facilitating the access to the toner supplying means.

93. The process of claim 51, in which toner agglomerates present in the pipe are broken by moving a wire mounted at least partly mobile in the pipe.

94. The process of claim 51, in which the device for filling toner powder from at least one supplying means in a toner container comprises at least:

several piping systems comprising each a flexible and compressible pipe, each piping system having each an inlet adapted to be connected to the supplying means for enabling a flow of toner powder from the supplying means and an outlet, maintaining means for maintaining at least one portion of each piping system so that the outlet of a pipe is at a level situated below the inlet of said pipe, compressing means for compressing a portion of each pipe, and moving means for ensuring for each pipe a relative movement between the compressing means and the portion to be compressed so as to create a pushing of the toner present in said portion towards the outlet.

95. The process of claim 94, in which the device comprises several peristaltic pumps as compressing and moving means.

96. The process of claim 51, in which the toner container to be filled is positioned on a support with a bottom provided with a foam element.

97. The process of claim 51, in which air is admitted in the portion of the pipe located between the compressing means and the inlet, so as to break possible toner agglomerates present in the pipe.

98. The process of claim 51, said process using said device comprising:

a piping system comprising several flexible and compressible pipes mounted in parallel, said piping system comprising an inlet adapted to be connected to the supplying means for enabling a flow of toner powder from the supplying means and with an outlet, maintaining means for maintaining at least one portion of the piping system so that the outlet of a piping system is at a level situated below the inlet of said piping system, compressing means for compressing a portion of each pipe, and moving means for ensuring for each pipe a relative movement between the compressing means and the portion to be compressed so as to create a pushing of the toner present in said portion towards the outlet.

99. The process of claim 51, in which the flexible and compressible pipe portion to be compressed has a wall thickness comprised between 0.1 and 1 cm.

100. The process of claim 51, in which the flexible and compressible pipe portion to be compressed has an inner diameter and a wall thickness comprised between 0.1 and 1 cm, whereby the ratio wall thickness/inner diameter is comprised between 1:5 and 1:2.

101. The process of claim 51, in which the flexible and compressible pipe portion to be compressed has an inner diameter and a wall thickness comprised between 0.1 and 1 cm, whereby the ratio wall thickness/inner diameter is comprised between 1:4.5 and 1:3.5.

* * * * *

UNITED STATES PATENT AND TRADEMARK OFFICE

CERTIFICATE OF CORRECTION

PATENT NO. : 7,249,616 B2
APPLICATION NO. : 10/940301
DATED : July 31, 2007
INVENTOR(S) : Giuseppe Turri et al.

It is certified that error appears in the above-identified patent and that said Letters Patent is hereby corrected as shown below:

In the Title Page (30):

Please delete "July 27, 2004 (IT) FR2004A0012" and insert --July 27, 2004 (IT) FR2004A000012--

Signed and Sealed this

Ninth Day of October, 2007

JON W. DUDAS
*Director of the United States Patent and Trademark Office*